US009852607B1

(12) United States Patent
Simmons

(10) Patent No.: US 9,852,607 B1
(45) Date of Patent: Dec. 26, 2017

(54) PERSONAL ALERT DEVICE

(71) Applicant: Willie Simmons, Macon, GA (US)

(72) Inventor: Willie Simmons, Macon, GA (US)

( * ) Notice: Subject to any disclaimer, the term of this patent is extended or adjusted under 35 U.S.C. 154(b) by 0 days.

(21) Appl. No.: 15/367,263

(22) Filed: Dec. 2, 2016

(51) Int. Cl.

| | |
|---|---|
| ***G08B 25/01*** | (2006.01) |
| ***G08B 25/10*** | (2006.01) |
| ***G08B 27/00*** | (2006.01) |
| ***G08B 3/06*** | (2006.01) |

(52) U.S. Cl.
CPC ..... *G08B 25/016* (2013.01); *G08B 3/06* (2013.01); *G08B 25/10* (2013.01); *G08B 27/001* (2013.01)

(58) Field of Classification Search
CPC ..... G08B 25/16; G08B 21/0423; G08B 21/0461; H04H 20/59
USPC ..... 340/8.1
See application file for complete search history.

(56) References Cited

U.S. PATENT DOCUMENTS

| | | | | |
|---|---|---|---|---|
| D126,852 | S | 4/1941 | Kaufman | |
| 5,546,887 | A | 8/1996 | Cameron | |
| 6,044,257 | A | 3/2000 | Boling et al. | |
| 8,907,808 | B2 | 12/2014 | Cienfuegos | |
| 8,957,774 | B2 | 2/2015 | Goldblatt | |
| 2005/0237736 | A1 | 10/2005 | Wimsatt | |
| 2006/0006998 | A1 * | 1/2006 | Carlson | A61B 5/0205 340/539.12 |
| 2008/0289565 | A1 | 11/2008 | Lin | |
| 2012/0137956 | A1 | 6/2012 | Cheng | |
| 2016/0050037 | A1 * | 2/2016 | Webb | H04B 5/0025 455/3.01 |

* cited by examiner

*Primary Examiner* — Vernal Brown

(57) ABSTRACT

A personal alert device for sending a panic signal and location coordinates includes a housing that defines an internal space. An inlet is positioned in a first end of the housing. The first end is configured to position between lips of a user. An outlet is positioned in the housing such that air passing from the inlet through the internal space and exiting through the outlet generates a whistling sound. A wall, coupled to the housing and positioned in the internal space, defines a compartment. An electronics module positioned in the compartment is configured to wirelessly communicate, to receive location coordinates, and to be activated by a user blowing air through the inlet. The housing emits the whistling sound and the electronics module is compelled to wirelessly communicate the panic signal and the location coordinates to at least one cellular phone and to emergency response personnel.

14 Claims, 4 Drawing Sheets

PERSONAL ALERT DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to alert devices and more particularly pertains to a new alert device for sending a panic signal and location coordinates.

BRIEF SUMMARY OF THE INVENTION

An embodiment of the disclosure meets the needs presented above by generally comprising a housing that defines an internal space. An inlet is positioned in a first end of the housing. The first end is configured to position between lips of a user. An outlet is positioned in the housing such that air passing from the inlet through the internal space and exiting through the outlet generates a whistling sound. A wall, coupled to the housing and positioned in the internal space, defines a compartment. An electronics module positioned in the compartment is configured to wirelessly communicate, to receive location coordinates, and to be activated by a user blowing air through the inlet. The housing emits the whistling sound and the electronics module is compelled to wirelessly communicate the panic signal and the location coordinates to at least one cellular phone and to emergency response personnel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
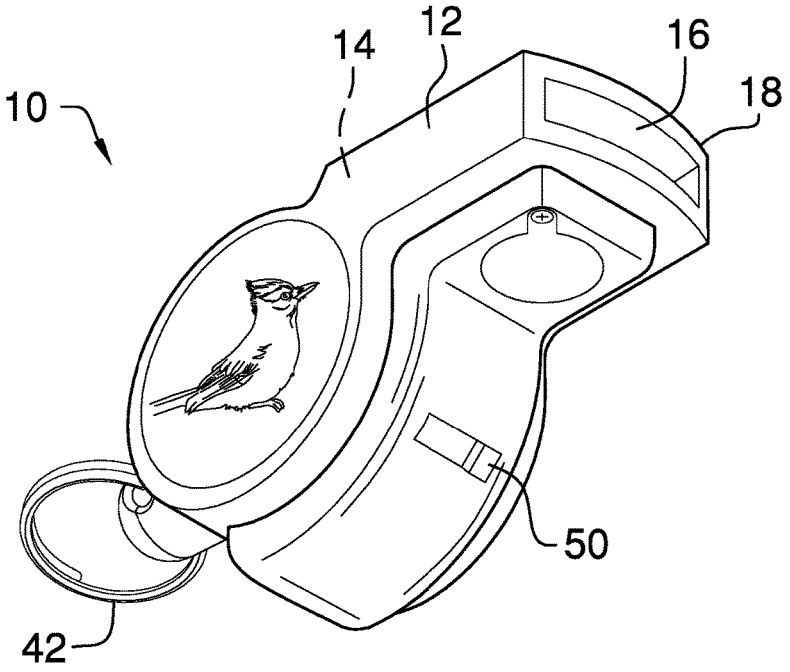
FIG. 1 is an isometric perspective view of a personal alert device according to an embodiment of the disclosure.
Figure 2:
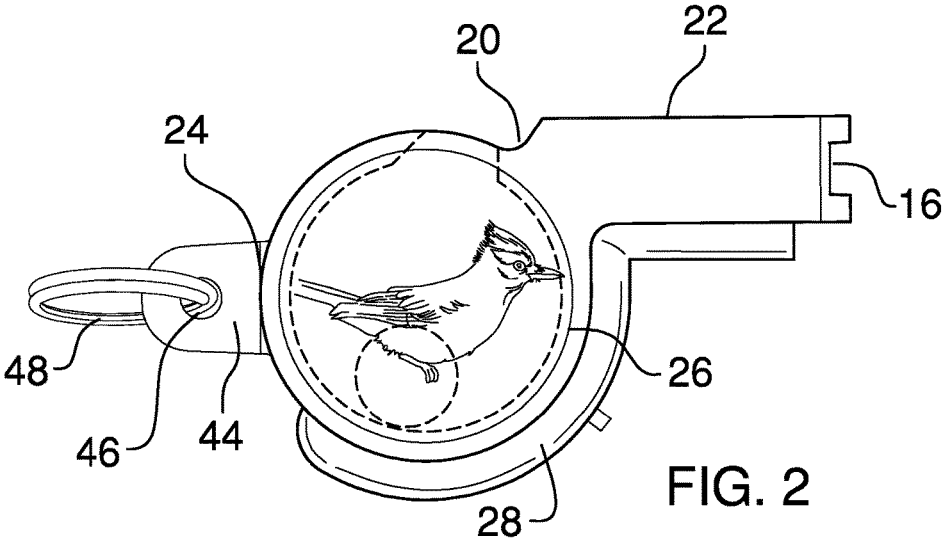
FIG. 2 is a side view of an embodiment of the disclosure.
Figure 3:
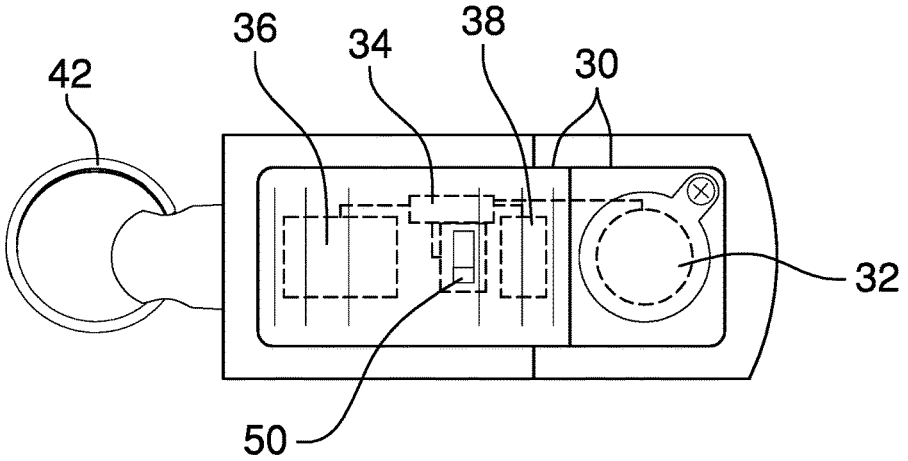
FIG. 3 is a cross-sectional view of an embodiment of the disclosure.
Figure 4:
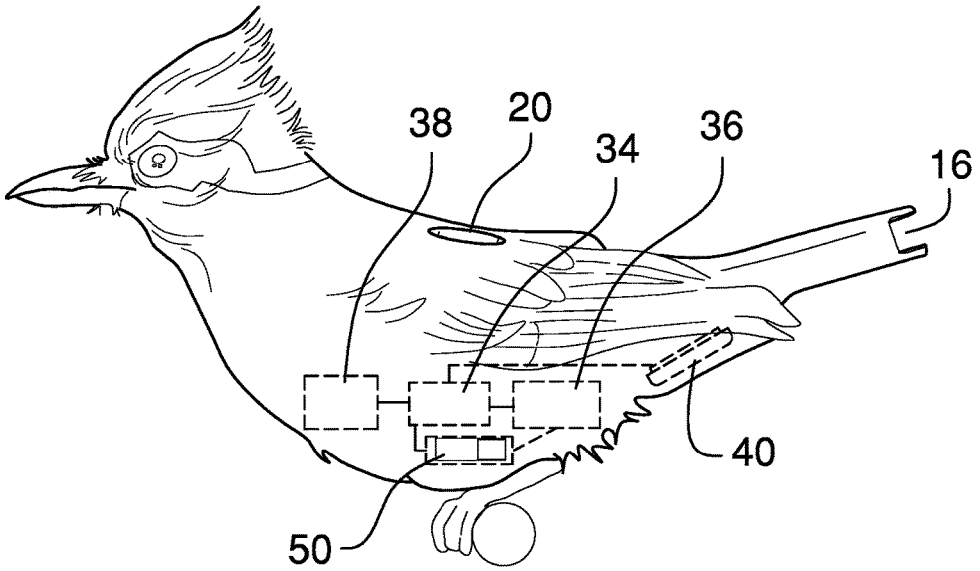
FIG. 4 is a cross-sectional view of an embodiment of the disclosure.
Figure 5:
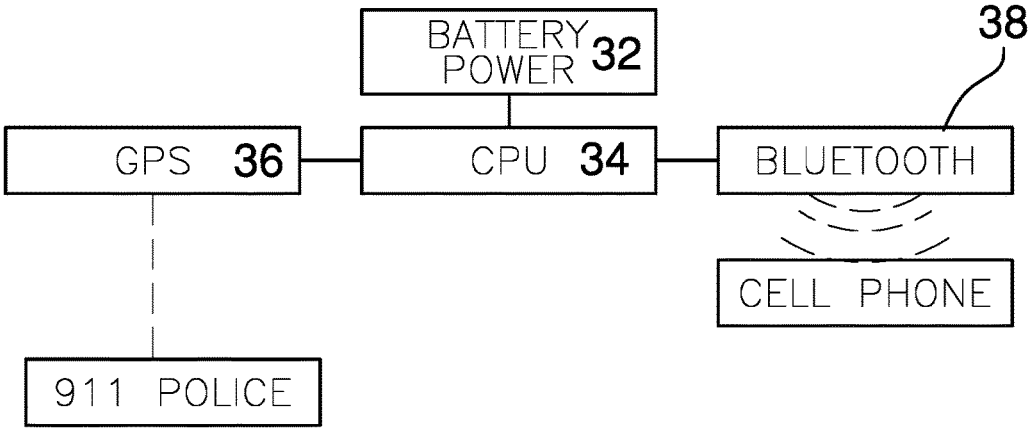
FIG. 5 is a block diagram of an embodiment of the disclosure.
Figure 6:
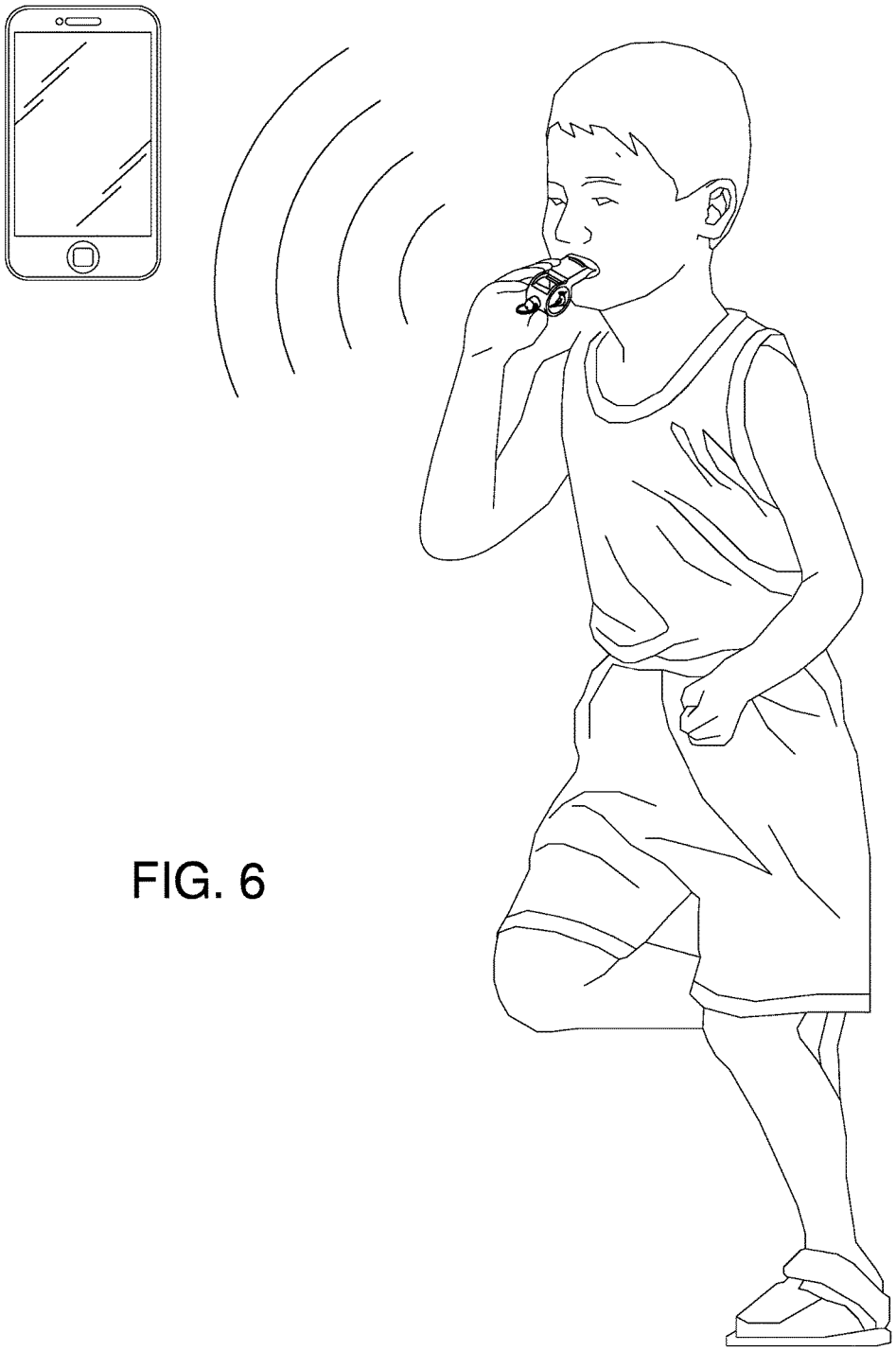
FIG. 6 is an in-use view of an embodiment of the disclosure.

With reference now to the drawings, and in particular to FIGS. 1 through 6 thereof, a new alert device embodying the principles and concepts of an embodiment of the disclosure and generally designated by the reference numeral 10 will be described.

As best illustrated in FIGS. 1 through 6, the personal alert device 10 generally comprises a housing 12 that defines an internal space 14. An inlet 16 is positioned in a first end 18 of the housing 12. The first end 18 is configured to position between lips of a user. An outlet 20 is positioned in the housing 12. The outlet 20 is positioned in the housing 12 such that air passing from the inlet 16 through the internal space 14 and exiting through the outlet 20 generates a whistling sound.

In one embodiment, the housing 12 is configured such that air passing from the inlet 16 through the internal space 14 and exiting through the outlet 20 generates a warning call of a blue jay. In another embodiment, the housing 12 is whistle shaped. In yet another embodiment, the housing 12 is bird shaped. In still yet another embodiment, the outlet 20 is positioned in a top 22 of the housing 12 substantially equally distant from the first end 18 and a second end 24 of the housing 12.

A wall 26 is coupled to the housing 12 and is positioned in the internal space 14. The wall 26 defines a compartment 28. An electronics module 30 is coupled to the housing 12 and is positioned in the compartment 28. The electronics module 30 is configured to wirelessly communicate. The electronics module 30 is configured to receive location coordinates of the user. In one embodiment, the electronics module 30 is configured to be activated by the user blowing air through the inlet 16. The inlet 16 is configured for the user to blow air through the inlet 16 such that the housing 12 emits the whistling sound and the electronics module 30 is compelled to wirelessly communicate a panic signal and the location coordinates of the user to at least one cellular phone and to emergency response personnel.

In one embodiment, the electronics module 30 comprises a power module 32, a microprocessor 34, a receiver 36 and a transmitter 38. The microprocessor 34 is operationally coupled to the power module 32. The receiver 36 and the transmitter 38 are operationally coupled to the microprocessor 34. The receiver 36 is global position system enabled. The receiver 36 is configured to receive the location coordinates of the user and to relay the location coordinates to the microprocessor 34. The microprocessor 34 is positioned to compel the transmitter 38 to wirelessly communicate the panic signal and the location coordinates to the at least one cellular phone and to the emergency response personnel. In another embodiment, the power module 32 comprises at least one battery 40.

A fastener 42 is coupled to the housing 12. The fastener 42 is configured to couple the housing 12 to an article of the user, such as a keychain. In one embodiment, the fastener 42 comprises a knob 44 that is coupled to the second end 24 of the housing 12. A penetration 46 is positioned through the knob 44. A ring 48 is positioned through the penetration 46. The ring 48 is configured to couple the housing 12 to the article of the user, such as a keychain.

In one embodiment, a switch 50 is coupled to the housing 12. The switch 50 is operationally coupled to the electronics module 30. The switch 50 is configured to send the panic signal to the electronics module 30. The electronics module 30 is compelled to wirelessly communicate the panic signal and the location coordinates of the user to the at least one cellular phone and to the emergency response personnel. In another embodiment, the switch 50 is slidable from an inactive position to an active position.

In use, the inlet 16 is configured for the user to blow air through the inlet 16 such that the housing 12 emits the whistling sound and the microprocessor 34 is compelled to compel the transmitter 38 to wirelessly communicate the panic signal and the location coordinates to the at least one cellular phone and to the emergency response personnel.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A personal alert device comprising:

a housing defining an internal space;

an inlet positioned a first end of said housing, said first end being configured for positioning between lips of a user;

an outlet positioned in said housing, wherein said outlet is positioned in said housing such that air passing from said inlet through said internal space and exiting through said outlet generates a whistling sound;

a wall coupled to said housing and positioned in said internal space defining a compartment;

an electronics module coupled to said housing and positioned in said compartment, said electronics module being configured for wireless communication, said electronics module being configured for receiving location coordinates of the user, said electronics module being configured for activating by the user blowing air through said inlet; and wherein said inlet is configured for the user to blow air through said inlet such that said housing emits the whistling sound and wherein said electronics module is compelled to wirelessly communicate a panic signal and the location coordinates of the user to at least one cellular phone and to the emergency response personnel.

2. The device of claim 1, further including said housing being configured such that the air passing from said inlet through said internal space and exiting through said outlet generates a warning call of a blue jay.

3. The device of claim 1, further including said housing being whistle shaped.

4. The device of claim 1, further including said housing being bird shaped.

5. The device of claim 1, further including said outlet being positioned in a top of said housing substantially equally distant from said first end and a second end of said housing.

6. The device of claim 1, further including said electronics module comprising:

a power module;

a microprocessor operationally coupled to said power module;

a receiver operationally coupled to said microprocessor, said receiver being global positioning system enabled;

a transmitter operationally coupled to said microprocessor; and wherein said receiver is positioned in said compartment such that said receiver is configured for receiving the location coordinates of the user and to relay the location coordinates to said microprocessor, wherein said microprocessor is positioned to compel said transmitter to wirelessly communicate a panic signal and the location coordinates to the at least one cellular phone and to the emergency response personnel.

7. The device of claim 6, further including said power module comprising at least one battery.

8. The device of claim 1, further including a switch coupled to said housing, said switch being operationally coupled to said electronics module, wherein said switch is positioned on said housing such that said switch is configured for sending the panic signal to said electronics module, wherein said electronics module is compelled to wirelessly communicate the panic signal and the location coordinates of the user to the at least one cellular phone and to the emergency response personnel.

9. The device of claim 8, further including said switch being slidable from an inactive position to an active position.

10. The device of claim 1, further including a fastener coupled to said housing, wherein said fastener is positioned on said housing such that said fastener is configured for coupling said housing to an article of the user, such as a keychain.

11. The device of claim 10, further including said fastener comprising:

a knob coupled to said second end of said housing;

a penetration positioned through said knob;

a ring positioned through said penetration; and wherein said ring is positioned through said penetration such that said ring is configured for coupling said housing to the article of the user, such as a keychain.

12. A personal alert device comprising:

a housing defining an internal space;

an inlet positioned a first end of said housing, said first end being configured for positioning between lips of a user;

an outlet positioned in said housing, wherein said outlet is positioned in said housing such that air passing from said inlet through said internal space and exiting through said outlet generates a whistling sound, said housing being configured such that the air passing from said inlet through said internal space and exiting through said outlet generates a warning call of a blue jay, said housing being whistle shaped, said outlet being positioned in a top of said housing substantially equally distant from said first end and a second end of said housing;

a wall coupled to said housing and positioned in said internal space defining a compartment;

an electronics module coupled to said housing and positioned in said compartment, said electronics module being configured for wireless communication, said electronics module being configured for receiving location coordinates of the user, said electronics module being configured for activating by the user blowing air through said inlet, wherein said inlet is configured for the user to blow air through said inlet such that said housing emits the whistling sound and wherein said electronics module is compelled to wirelessly communicate a panic signal and the location coordinates of the user to at least one cellular phone and to the emergency response personnel, said electronics module comprising:

a power module, said power module comprising at least one battery, a microprocessor operationally coupled to said power module, a receiver operationally coupled to said microprocessor, said receiver being global positioning system enabled, wherein said receiver is positioned in said compartment such that said receiver is configured for receiving the location coordinates of the user and to relay the location coordinates to said microprocessor, and a transmitter operationally coupled to said microprocessor, wherein said microprocessor is positioned to compel said transmitter to wirelessly communicate a panic signal and the location coordinates to the at least one cellular phone and to the emergency response personnel;

a fastener coupled to said housing, wherein said fastener is positioned on said housing such that said fastener is configured for coupling said housing to an article of the user, such as a keychain, said fastener comprising:

a knob coupled to said second end of said housing, a penetration positioned through said knob, and a ring positioned through said penetration, wherein said ring is positioned through said penetration such that said ring is configured for coupling said housing to the article of the user, such as a keychain; and wherein said inlet is configured for the user to blow air through said inlet such that said housing emits the whistling sound and wherein said microprocessor is compelled to compel said transmitter to wirelessly communicate the panic signal and the location coordinates to the at least one cellular phone and to the emergency response personnel.

13. The device of claim 12, further including said housing being bird shaped.

14. The device of claim 12, further including a switch coupled to said housing, said switch being operationally coupled to said electronics module, wherein said switch is positioned on said housing such that said switch is configured for sending the panic signal to said electronics module, wherein said electronics module is compelled to wirelessly communicate the panic signal and the location coordinates of the user to the at least one cellular phone and to the emergency response personnel, said switch being slidable from an inactive position to an active position.

* * * * *